US007785450B2

(12) United States Patent
Maget

(10) Patent No.: US 7,785,450 B2
(45) Date of Patent: Aug. 31, 2010

(54) "ON-SITE" CARBON DIOXIDE GENERATOR

(75) Inventor: Henri J. R. Maget, La Jolla, CA (US)

(73) Assignee: Med-E-Cell, San Diego, CA (US)

( * ) Notice: Subject to any disclaimer, the term of this patent is extended or adjusted under 35 U.S.C. 154(b) by 909 days.

(21) Appl. No.: 11/650,016

(22) Filed: Jan. 5, 2007

(65) Prior Publication Data

US 2007/0181419 A1 Aug. 9, 2007

Related U.S. Application Data

(60) Provisional application No. 60/765,392, filed on Feb. 3, 2006.

(51) Int. Cl.
*C25B 9/08* (2006.01)
*C25B 9/04* (2006.01)

(52) U.S. Cl. ..... 204/258; 204/253; 204/257; 204/263; 204/266

(58) Field of Classification Search ..... 204/253, 204/257, 258, 263, 266
See application file for complete search history.

(56) References Cited

U.S. PATENT DOCUMENTS 4,376,097 A * 3/1983 Emelock ..... 422/189
6,299,744 B1 * 10/2001 Narayanan et al. ..... 204/263
6,387,228 B1 * 5/2002 Maget ..... 204/230.2
6,432,284 B1 * 8/2002 Narayanan et al. ..... 204/263
6,780,304 B1 * 8/2004 Maget ..... 205/555

* cited by examiner

*Primary Examiner*—Bruce F Bell
(74) *Attorney, Agent, or Firm*—Steins & Associates, P.C.

(57) ABSTRACT

Systems are described for the "on-site" production of substantial amounts of carbon dioxide and hydrogen. The systems include a stack of multiple electrochemical cells, which decompose organic carboxylated compounds into $CO_2$ and $H_2$ without leaving any residue. From a bench-top small generator, producing about 1 lb of $CO_2$ per day to a large-scale generator producing 1 ton of $CO_2$ per day, the process is essentially identical.

Oxalic acid, either anhydrous or in its dihydrate form, is used to efficiently generate the gases. The energy required is less than 0.3 Kilowatt-hours per lb of $CO_2$ generated. Individual cells operate at less than 1.2 volts at current densities in excess of 0.75 amps/cm$^2$. $CO_2$ production rates can be controlled either through voltage or current regulation. Metering is not required since the current sets the gas production rate. These systems can competitively replace conventional compressed $CO_2$ gas cylinders.

74 Claims, 7 Drawing Sheets

$CO_2$
AIR
A
C

"ON-SITE" CARBON DIOXIDE GENERATOR

This application claims the priority of U.S. Provisional Patent Application No. 60/765,392 filed Feb. 3, 2006.

TECHNICAL FIELD

Commercial carbon dioxide ($CO_2$) is generally manufactured by separation and purification from $CO_2$-rich gases produced by combustion or biological processes. It is also found in underground formations in some U.S. states.

$CO_2$ is commercially available as high-pressure cylinder gas (about 300 psig), refrigerated liquid or as a solid (dry ice).

Common uses of $CO_2$ include fire extinguishing systems, carbonation of soft drinks and beer; freezing of food products, refrigeration and maintenance of environmental conditions during transportation of food products, enhancement of oil recovery from wells, materials production (plastics, rubber), treatment of alkaline water, etc.

Applications include:

- shield during welding where it protects the weld against oxidation
- dry ice pellets for sand blasting surfaces, without leaving residues
- in the chemical processing industry, such as methanol production
- priming oil wells to maintain pressure in the oil formation
- removing flash from rubber or plastic objects by tumbling with dry ice
- creation of inert blankets or environments
- carbonation of soft drinks, beers and wine
- preventing fungal and bacterial growth
- as an additive to oxygen for medical use—as a propellant in aerosol cans
- maintaining a level of 1000 ppm in green houses to increase production yields of vegetables, flowers, etc.

To meet the needs of these various applications, requiring from small quantities of $CO_2$ (less than a pound/day) to extremely large quantities (tons/day), $CO_2$ is available as:

a compressed gas requiring heavy cylinders, or a liquid under pressure available from tube or liquid trailers, or as solid dry ice.

Very small users rely on high pressure cylinders. Their distribution is generally conducted by locally-focused businesses that buy the gas in bulk liquid form and package it at their facilities.

Small to medium size customers truck-in bulk liquid products that are then processed through evaporation to produce the gas.

Larger customers' needs are often met with "tube trailers", i.e. bundles of high-pressure cylinders mounted on wheeled platforms.

"Onsite" plants are usually installed by customers consuming more than 10 tons/day of the gas.

There is an increasing interest in user-owned, small, non-cryogenic gas generators, in many markets. Such generators are available for oxygen, hydrogen and nitrogen, but not for carbon dioxide.

For example, small to medium size users of oxygen or nitrogen may find an economical supply alternative in pressure-swing-adsorption (PSA) plants. Or again, hydrogen and oxygen may be produced through electrolysis of water. High purity hydrogen may then be produced by purification of the stream by using palladium foil diffusers.

The benefits of these "on-site" generators are multiple:

generation on demand, as needed independence from suppliers and possible supply interruptions cost-insensitivity to supply issues no need for pressure vessels, their storage and recycling Etc.

To-date, "on-site" economical carbon dioxide generators, such as are available for hydrogen and oxygen, do not exist, although the demand for carbon dioxide is substantial

SUMMARY AND OBJECTS OF THE INVENTION

It is the primary object of this invention to provide for an "on-site" generator of carbon dioxide which can controllably generate substantial quantities of carbon dioxide, that does not require a combustion or biological process, while producing carbon dioxide on demand in an economical manner.

It is another object of this invention to provide "on-site" systems capable of generating mixed $CO_2$ and $H_2$ streams or streams of the purified gases.

The applicant has invented an electrolytic process and method to produce carbon dioxide from organic acids that were originally described in U.S. Pat. Nos. 6,780,304 B1 and 6,387,228 B1. He has pursued the development of that generation technology by developing multiple electrochemical cells assembled in stacks to achieve production rates and volumes much larger than those described in these patents.

DESCRIPTION OF THE PREFERRED EMBODIMENT

The novel multi-cell generators will now be described by referring to FIGS. 1-10 of the drawings. The same structural members in the various embodiments will be identified by the same numerals.

Figure 1:
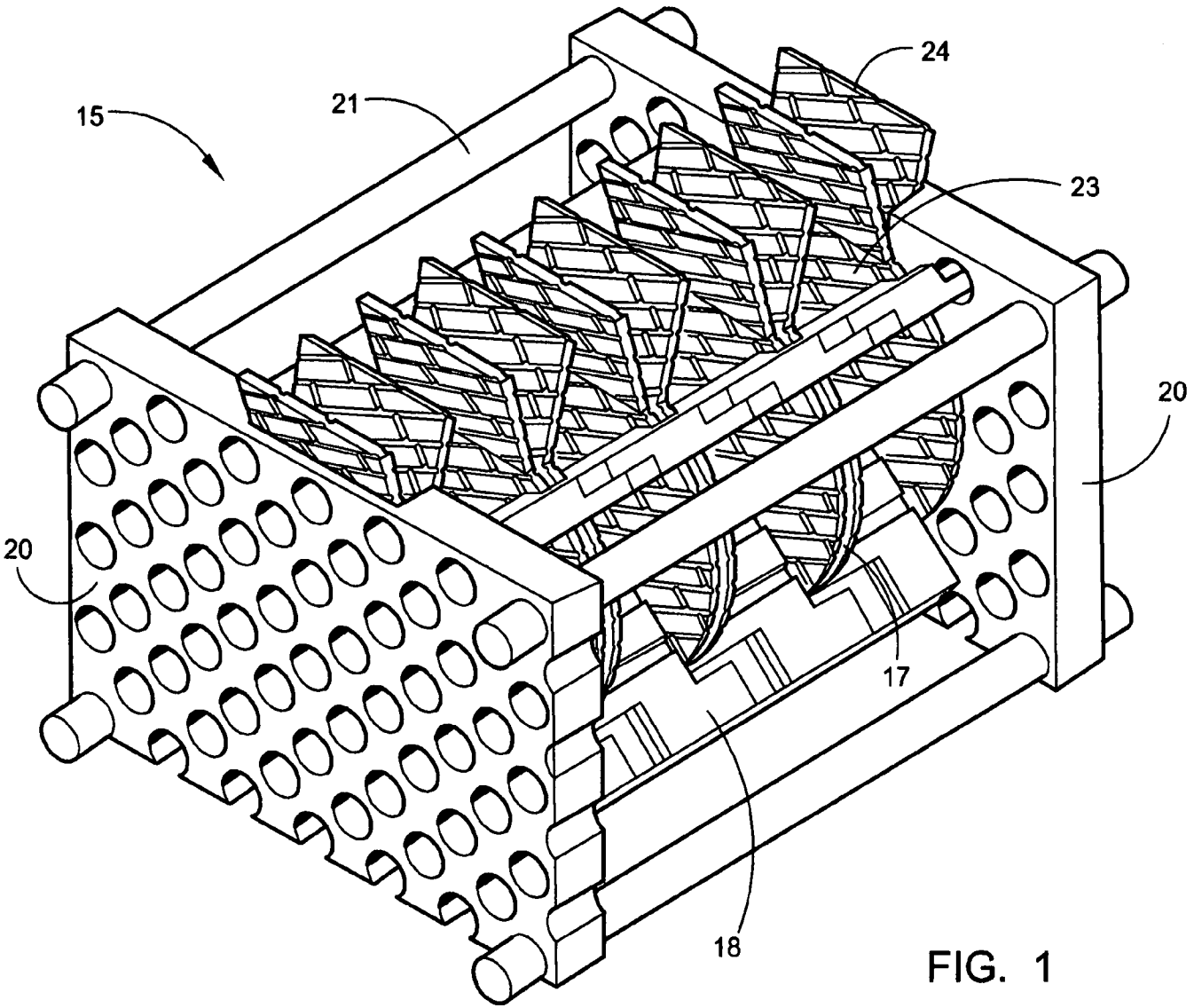
FIG. 1 is a schematic front perspective view of a multi-cell generator stack for producing carbon dioxide and hydrogen from oxalic acid, an organic acid.

The multi-cell generator 15 of FIG. 1 consists of five individual electrochemical cells 17 kept under compression and alignment by means of four separators 18. Two stack end plates 20 are placed at opposite ends of the stack and put under compression by means of four compression rods 21. End plates 20 are perforated plates (plastic or metal) to allow access of the organic acid to, and gas evolution from, the electrode surfaces of the electrochemical cells. Each individual cell 17 has current collectors 23 with flaps 24. Flaps 24 of appropriate length, provide means to interconnect the various current collectors 23. The complete stack is immersed in a (super-saturated) solution of an organic carboxylated acid such as oxalic acid.

Figures 2A, 2B, 5:
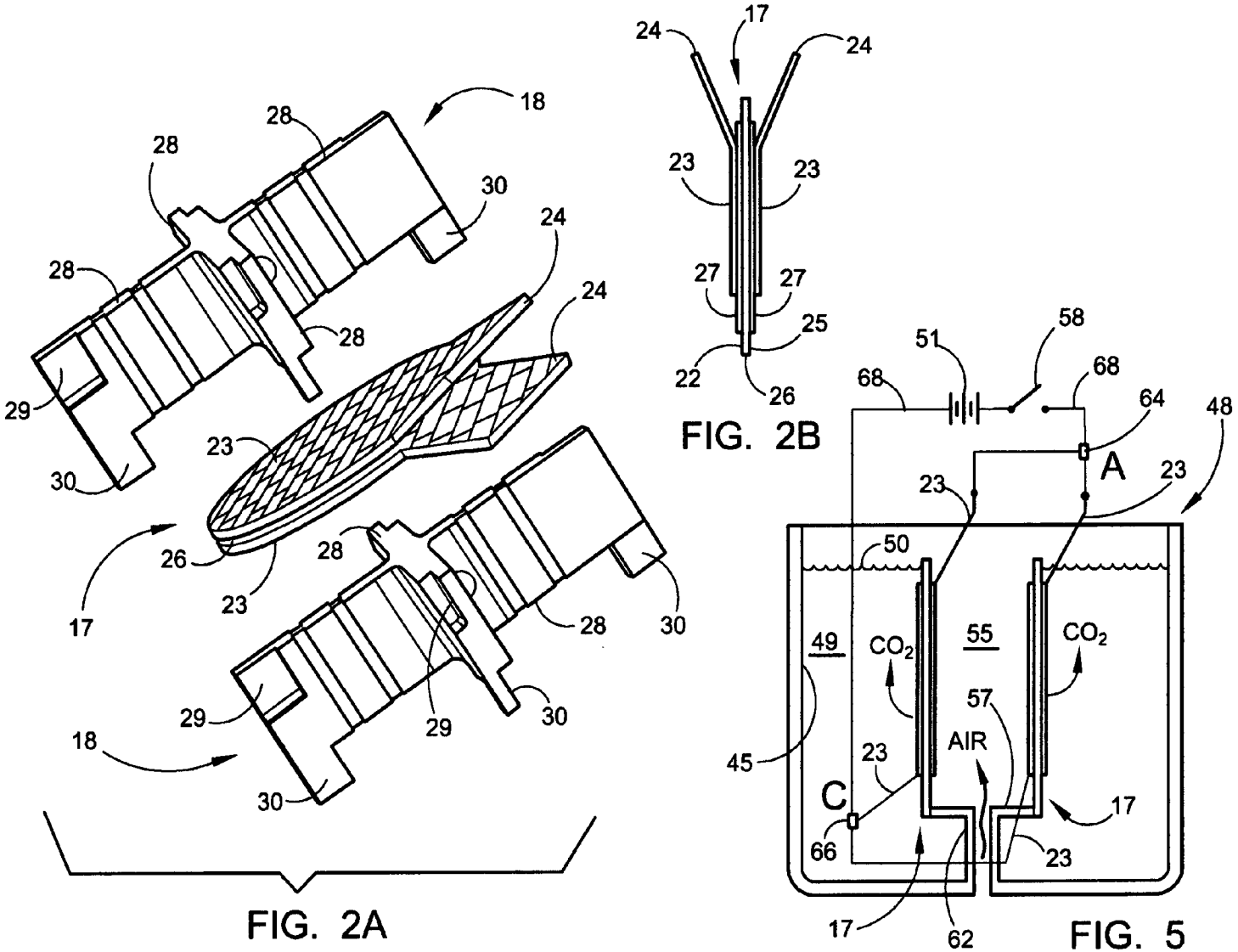
FIG. 2A is an exploded perspective view of the various components that make up individual cells.
FIG. 2B is an enlarged schematic front elevation view of an electrochemical cell.
FIG. 5 is a schematic cross sectional view of a carbon dioxide generation system in which the hydrogen is allowed to electrochemically react with air within the generator, thereby decreasing the energy required to operate the system.

FIG. 2A is a schematic representation of single electrochemical cell 17 that includes an ionic conductor 26 "sandwiched" between two electrodes 27 (see FIG. 2B) and two current collectors 23. Ionic conductor 26 has a left outer surface 22 and a right outer surface 25. Separators 18 consisting of four arms 28 are interlocked by means of grooves 29 and tongues 30, which provides for a rigid structure similar to a human vertebral column and disks. Electrodes 27 can either be situated on each side of ionic conductor 26 or can be integrated within the current collectors 23. If the organic solution is an adequate proton carrier it becomes its own ionic conductor and integral electrode/current collectors can be used. In all instances described herein, the ionic conductor is a proton exchange membrane conducting protons from electrode to electrode. Proton exchange membranes of this type are available as Nafion films from DuPont & Co.

The size of electrochemical cells 17 can vary from sub-$cm^2$ areas, as described in a co-pending patent application, to $m^2$ as used for brine electrolysis. The examples discussed later in the description make use of this wide range of sizes.

Current collectors 23 are open-mesh structures that allow easy access of the carboxylated acid solution to the electrodes and they provide for a low resistance path for electron transfer from the external circuit. In some instances a dual current collector is used, i.e. a thin screen is embedded in the electrode and a thicker current collector is maintained in tight contact with the screen.

Figure 3:
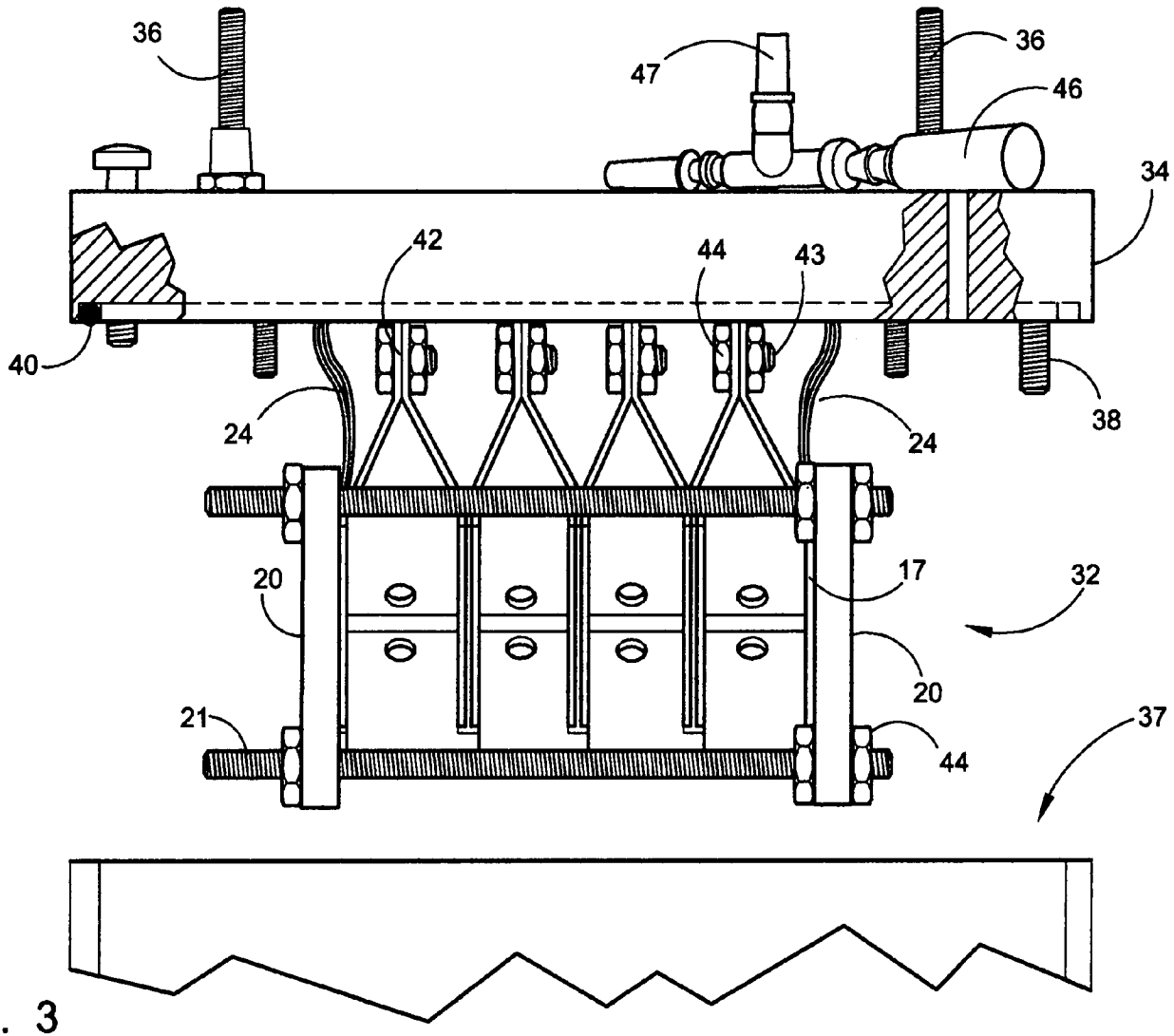
FIG. 3 is a side elevation view of the principal components of a self-contained carbon dioxide generation system.

FIG. 3 is a side view of a multi-cell generator stack 32 attached to a container lid 34. Means of attachment to the lid are bent collector flaps 24 which are connected to terminals 36 The lid 34 is securely attached to the container body 37 by means of four lid attachment screws 38. Lid 34 also holds seal 40 that ensures a gas tight container. Inter-cell connections 42 are achieved by using short threaded rods 43 and nuts 44 and these combinations provide for low inter-cell connection resistance. A gas exit line 46 and port 47 allow for gas generated within the container 37 to exit the sealed system. During operation the stack is completely immersed in the acid solution.

Figure 4B:
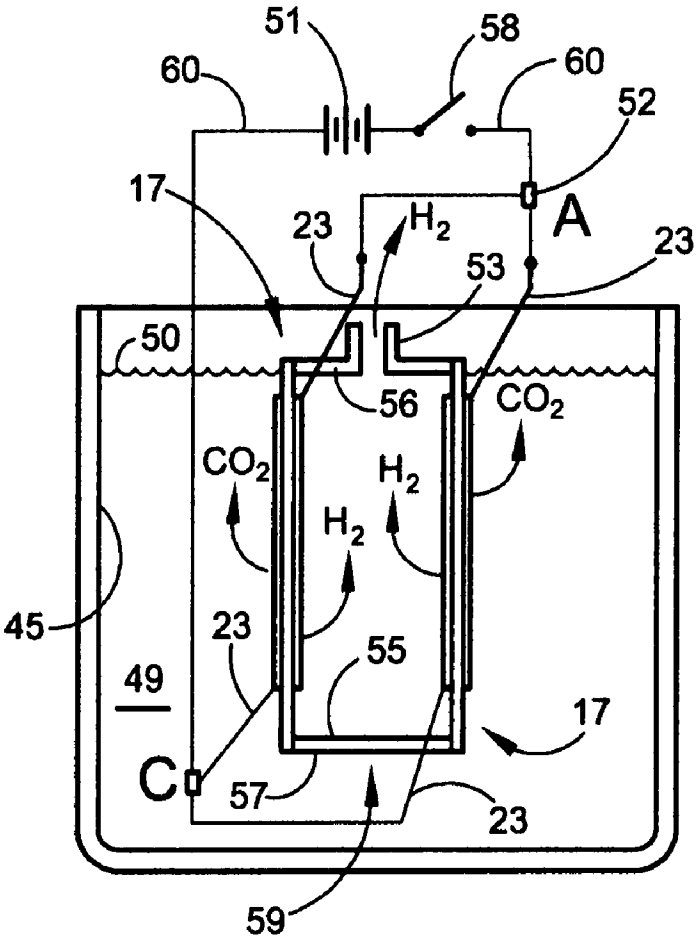
FIG. 4B is a schematic cross sectional view of a second version of a multi-cell stack inter-cell connection that (separately) generates carbon dioxide and hydrogen streams.
Figure 4A:
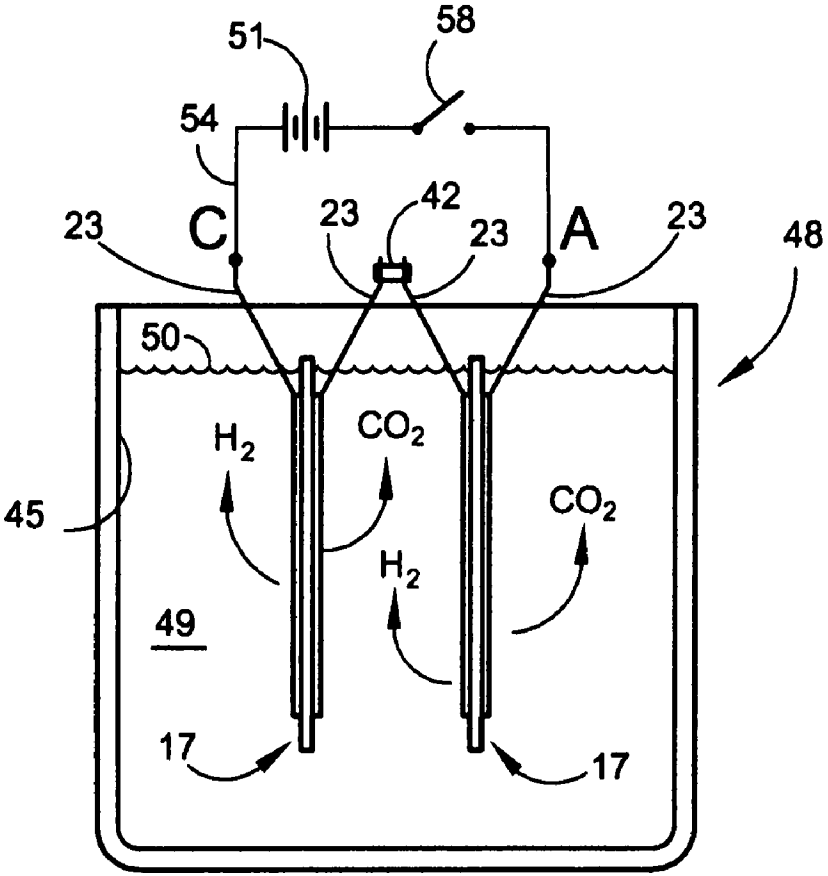
FIG. 4A is a schematic cross sectional view of a first version of a multi-cell stack inter-cell connection that generates a mixture of carbon dioxide and hydrogen.

FIGS. 4A and 4B illustrate different interconnections between electrodes to achieve either mixing of gases or gas separation. In FIG. 4A adjacent current collectors 23 from two cells 17 are interconnected at 42 and the counter current collectors 23 become cathode C and anode A. Both cells are immersed in solution 49 in chamber 45 of container 48 with the liquid level 50 preferably completely covering the electrodes. A source of electrical current 51 (usually a battery) is connected to an electrical circuit 54 having a switch 58. Electrical circuit 54 is connected between cathode C and anode A.

In FIG. 4B alternate current collectors 23 are connected at 52 resulting in $H_2$ gas being generated at adjacent electrodes. In this arrangement $H_2$ evolves at facing electrodes and is evacuated through gas exit port 53. Since $H_2$ evolution does not require the presence of the organic acid solution, the chamber 55 between the electrodes can be sealed off by top wall 56 and bottom wall 57 to create a watertight secondary container 59. This embodiment has an electrical circuit 60.

FIG. 5 is a modification of FIG. 4B. In this instance, port 62 is provided to allow air to be injected into the $H_2$ generation chamber 55. Two of the alternate current collectors 23 are connected at 64. The other two current collectors are connected at 66. Electrical circuit 68 is connected between cathode C and anode A. The oxygen from the air acts as a depolarizer (see equation 3) thereby preventing the formation of $H_2$. Air injected in the hydrogen evolution cavity 55 will react electrochemically with protons, thereby reducing the energy (voltage) required to perform the electrolytic process.

Figure 6:
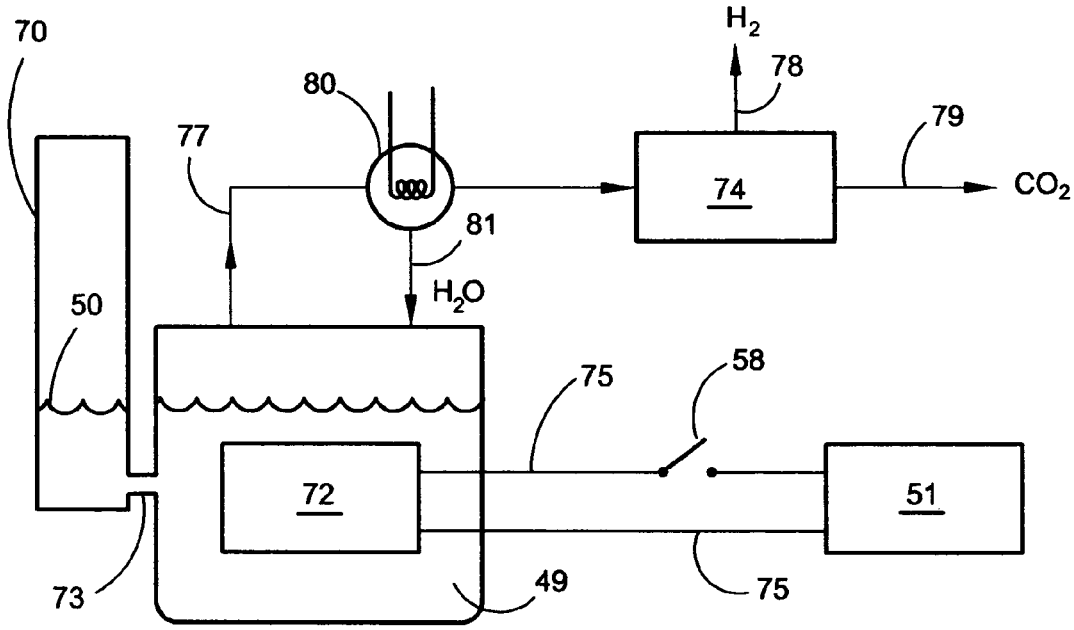
FIG. 6 is a schematic illustration of a carbon dioxide generator producing mixed carbon dioxide and hydrogen and where the mixture is processed externally to the system to generate pure carbon dioxide and pure hydrogen.

FIG. 6 is a schematic representation of a complete system, including the DC power source 51, acid feeder sub-system 70 (hopper) to feed carboxylic acid to the generator 72 and external processing unit 74. The hopper is filled either with solid oxalic acid or oxalic acid contained in water permeable bags from which the acid can be dissolved and moved into the generator container by means of conduit and feed port 73 placed below the liquid level 50 of the aqueous oxalic acid solution 49. By maintaining the liquid level 50 above the feed port the acid is progressively dissolved and can migrate to the electrochemical generator 72.

When the DC power supply 51 is connected to the electrochemical stack by means of switch 58 and power lines 75, $CO_2$ and $H_2$ are generated and transported by means of conduit 77 to gas processing unit 74 where the gases are separated and released as $H_2$ through conduit 78 and $CO_2$ through conduit 79. Water entrained by the gas stream is recovered by means of condenser/scrubber 80 and recycled to the generator 72 by means of conduit 81.

Figure 7A:
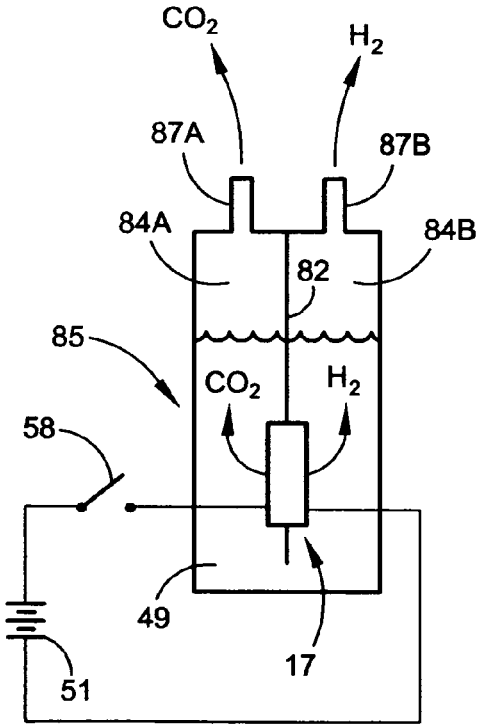
FIG. 7A is a schematic illustration of a first single cell generator releasing $CO_2$ and $H_2$ separately.
Figure 7B:
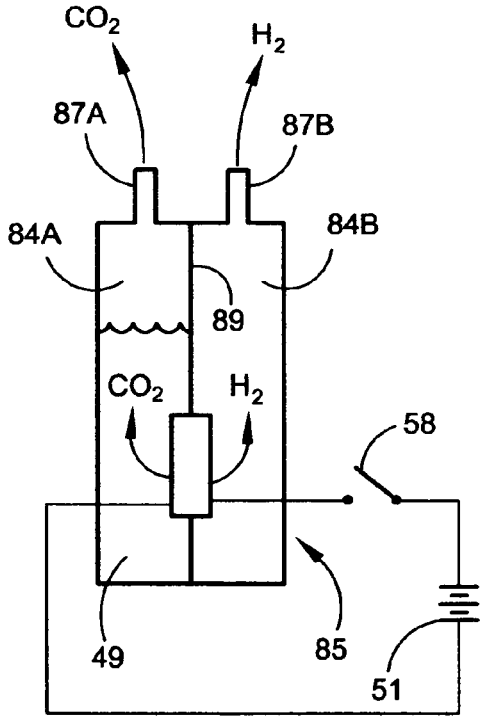
FIG. 7B is a schematic illustration of a second single cell generator releasing $CO_2$ and $H_2$ separately.

FIGS. 7A and 7B illustrate the concept of a single-cell electrolyzer allowing for separate recovery of $CO_2$ and $H_2$. In FIG. 7A, a single electrochemical cell 17, incorporated in partition 82 forms two distinct chambers 84A and 84B, is immersed in oxalic acid solution 49. Partition 82 does not fully extend to the bottom of container 85 to allow for liquid motion between compartments without allowing gases to escape into adjacent chambers. Two separate gas exit ports 87A and 87B are provided to allow separate exits for $CO_2$ and $H_2$. In FIG. 7B, partition 89 completely separates container 85. Since the $H_2$ evolution does not require the presence of oxalic acid solution, the solution is only provided in compartment 84A, partially defined by the oxalic acid decomposition electrode. In this instance also the gases are released through two different exit lines 87A and 87B.

Figure 8:
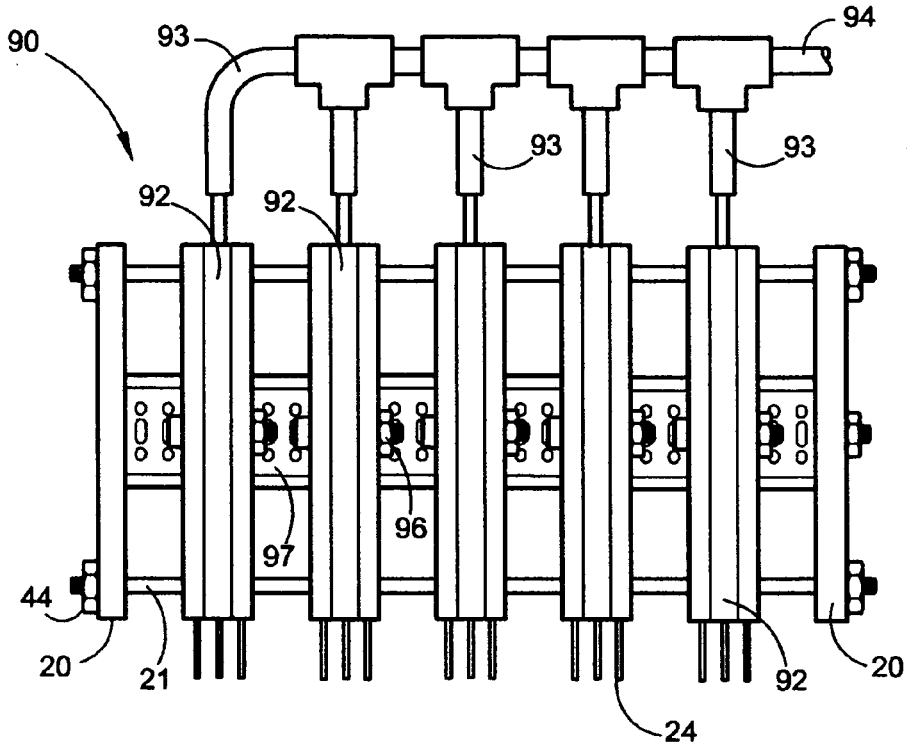
FIG. 8 is a schematic view of a multi-cell $CO_2$ generator where one of the generated gases, $CO_2$ or $H_2$, is collected separately from the other.

In FIG. 8 one of the gases can be collected in a separate collection chamber within the multi-cell electrolyzer 90. Either $CO_2$ or $H_2$ can be collected separately. For the sake of this description, we have assumed that $H_2$ is the separated gas while $CO_2$ is allowed to bubble freely in, and from, the solution. The generator 90 consists of five separate $H_2$ collection chambers 92 (and therefore 10 electrochemical cells), releasing $H_2$ from evacuation lines 93, merging into a single $H_2$ gas exhaust line 94. Each individual $H_2$ chamber assembly 91 is bolted together by means of nuts and bolts 96, as a single subassembly. These subassemblies are separated from each other by means of perforated separators 97. The separators are perforated to allow gas to freely move upward from the solution. The complete generator structure 90 is bolted together by means of compression rods 21, nuts 44 and end plates 20. The compression rods and separators are used to maintain good electrical contact between current collectors 23 and the electrode surfaces. This is particularly important when cells operate at high current densities, i.e. 2 amps/cm$^2$. Current collectors 23 (four for each $H_2$ chamber) are electrically connected in a manner such that each individual cell in the chambers releases $H_2$ whereas each individual counter-electrode releases $CO_2$. In operation, the complete structure is submerged into the oxalic acid solution.

Figure 9:
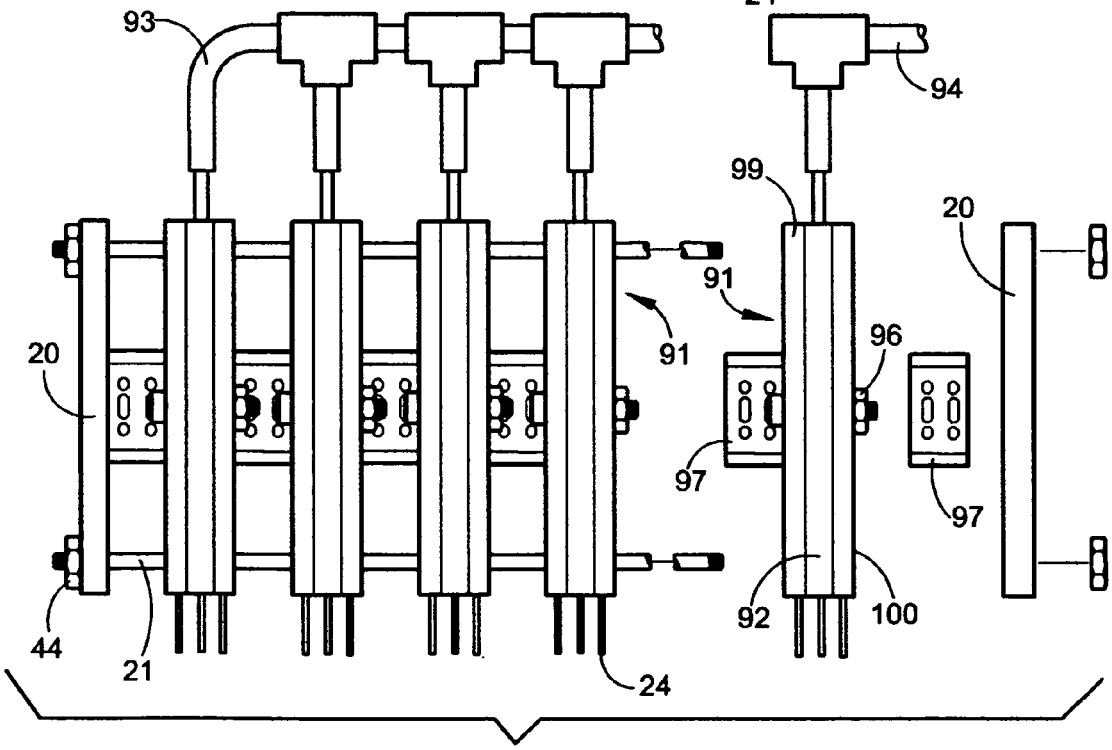
FIG. 9 is a partially exploded schematic view showing the assembly steps of a generator allowing for gas separation.

FIG. 9 shows that each $H_2$ chamber assembly 91 is an autonomous unit progressively stacked between end plates 20. Each separator 97 fits within a cavity of the $H_2$ chamber end plates 99.

Figure 10:
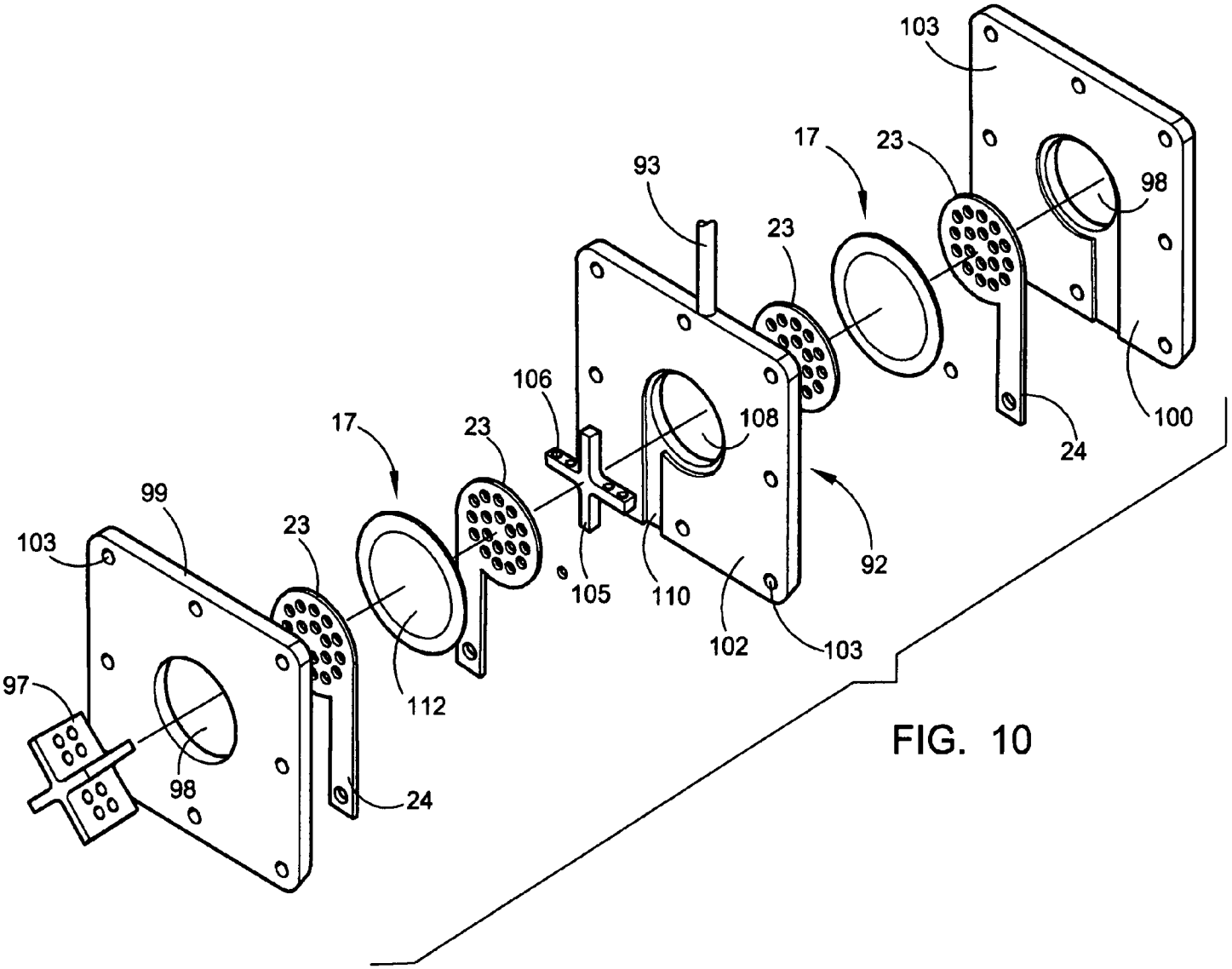
FIG. 10 is an exploded schematic perspective view of the individual components used to assemble a gas collection chamber.

In FIG. 10, the $H_2$ compartment 92 consists of two end plates 99 and 100 and an elastomeric center plate 102, all of which are perforated with 8 holes 103, four of which are used for the compression rods and four of which are used to bolt the individual chambers together. End plates 99 have cavities or central apertures 98. Center plate 102 is further provided with a gas exit line 93. To assemble the unit, first separator 105, provided with perforated arms 106 to allow free flow of $H_2$ in the chamber, is located within the cavity 108 of the center plate 102. Then current collectors 23 are placed on both sides of the separator, their perforated flaps 24 fitting within the groove 110 of the center plate 102. Current collectors 23 can be either a perforated metal or a metal screen that allows free flow of gases away from the electrodes 112 of electrochemical cells 17. The electrochemical cells are placed against the current collectors 23. A $H_2$ chamber 92 is thereby defined by two electrochemical cells and a center plate 102. Finally, current collectors 23 are placed on top of cells 17, respectively. All components are bolted together to form a $H_2$ collection chamber 92. An internal seal is achieved by using end plates 99 and 100 to compress the outer ring of electrochemical cells 17 against the elastomeric center plate 102. Simultaneously, the end plates 99 and 100 also compress the flaps 24 of current collectors 23 against the elastomeric center plate 102. Separators 97 fit within the cavity 98 of end plates 100. When compressed with compression rods 21 the end plates apply a load onto current collectors 23 to achieve a good electrical contact with the electrodes of the electrochemical cell. The function of separator 97 is to prevent the cells from bending, an action which would increase the internal resistance. Since the generator may be required to operate under high current loads it is essential that internal resistances be kept at a minimum to reduce the generator voltage.

The ease and simplicity of controlling the process was illustrated by an experiment with an AC/DC converter, rated at 3.3 amps, maximum, (input 100-240 volts AC, 47-63 Hz, 0.7 amps), that was directly connected to the generator terminals, without additional current and/or voltage regulation. A steady-state operating condition of 2.85 amps, 4.94 volts and a generator temperature of 55 degree Celsius were observed. This type of "desk-top" generator is capable of producing over 300 liters of $CO_2$ per day (more than 1 lb/day).

Oxalic acid is the preferred carboxylic acid for the generation of $CO_2$. Either anhydrous oxalic acid $(COOH)_2$ or the dihydrate $(COOH)_2.2H_2O$ can be used for the generator.

By activating switch 33, a current is applied to the electrochemical stack immersed in the aqueous oxalic acid solution.

The anode reaction is: $(COOH)_2 \rightarrow 2CO_2 + 2H^+ + 2e^-$ Eqn. 1

The cathode reaction is: $2H^+ + 2e^- \rightarrow H_2$ Eqn. 2

The generation of $H_2$ can be beneficially used as an independent gas stream, or evolve simultaneously with $CO_2$ to create an anaerobic gas mixture of 66.7% $CO_2$ and 33.3% of $H_2$.

Whenever $H_2$ is not beneficially used, the cathode reaction can be mitigated by using an air depolarized cathode, i.e. supplying oxygen or air to the cathode chamber such that reaction of eqn. 2 now becomes:

$$2H^+ + 2e^- + \tfrac{1}{2}O_2 \rightarrow H_2O \qquad \text{Eqn. 3}$$

and the electrochemical decomposition process results solely in the production of $CO_2$ and water.

The following materials compositions options are available:

| Organic Acid | A. H2 recovery | B. H2 Consumption |
|---|---|---|
| 1. Oxalic acid anhydrous | $2\,CO_2 + H_2$ | $2\,CO_2 + H_2O$ |
| 2. Oxalic acid dihydrate | $2\,CO_2 + H_2 + 2H_2O$ | $2\,CO_2 + 3\,H_2O$ |

Processes 1A and 2A allow for $H_2$ recovery

Processes 1B and 2B allow for oxidation of $H_2$ to water to reduce process energy needs.

In instances where water is a rare commodity, oxalic acid dihydrate can be substituted for anhydrous oxalic acid. The dihydrate $(COOH)_2.2H_2O$ contains about 28.5% of water by weight that is released during the electrolytic process. The generation of $CO_2$ does not require any additional water, except possibly when immediate full rated output is required. However, even then, only a minimum of water is required to solubilize the oxalic acid to allow access of the solution to the generation electrodes.

Since heating of the acid solution or slurry increases the oxalic acid solubility, it is beneficial to insulate the generator to allow its operation at higher temperatures, which results in a substantial reduction of the specific power requirements, i.e. kilowatts/(lb of $CO_2$/hr).

The electrolytic process can also be conducted under pressure, which can be beneficial for the recovery of water and the separation of $CO_2$ from $H_2$.

The generator systems described so far produce $CO_2$ and $H_2$. In some instances the streams do not need separation, in others it is essential to generate high purities of each constituent.

Whenever separation is desired, multiple processes are available to achieve that result.

Some of these are briefly described in the following:

- compression with the possible result that liquid or solid $CO_2$ is produced, while $H_2$ is released as a gas;
- absorption by a solution where $CO_2$ is preferentially extracted and $H_2$ is released; then through a secondary process $CO_2$ is released;
- adsorption by a material such as metal powders that preferentially produce a metal hydride which can be recovered by heating the metal;
- membrane separation where a passive process based on a partition coefficient either preferential to $CO_2$ or $H_2$ is used to enrich the gas streams;
- thin metal (Palladium) foil separation of hydrogen;
- electrochemical extraction of $H_2$ from the gas stream, releasing nearly pure $CO_2$ and $H_2$.
- Hydrogen-hydrogen cells are extremely efficient and able to carry loads in excess of 5 amps/cm$^2$. Such an electrochemical $H_2$—$H_2$ cell has been described by Maget in U.S. Pat. No. 3,489,670.

If $H_2$ is undesirable either in the $CO_2$ gas stream or as a by-product, $H_2$ can be converted into thermal energy in the following manners:

catalytic combustion of hydrogen to produce water, or electrochemical oxidation of $H_2$ to water in presence of air. The by-product of his process is the generation of power that can be used to reduce the energy needed to generate $CO_2$. This process is illustrated in example 5.

The electrochemical process is DC driven. Power sources can be either AC-DC converters, batteries or solar photovoltaic cells, that are well suited for this process since they also operate at low voltages and high currents.

Example 1

A single cell is placed in a container holding supersaturated oxalic acid dihydrate in form of a slurry. The cell, having a surface area of 8.3 $cm^2$ is connected to a DC power supply. The following table summarizes some observed currents and voltages displayed by the cell, at 25° C.:

| | | Production Rate of $CO_2$ | |
|---|---|---|---|
| Cell current, amps | Cell voltage, volts | Liters/hr | lbs/day |
| 1.5 | 1.06 | 1.3 | 0.13 |
| 3.0 | 1.20 | 2.7 | 0.26 |
| 4.0 | 1.30 | 3.6 | 0.35 |
| 5.0 | 1.44 | 4.5 | 0.44 |
| 6.0 | 1.64 | 5.5 | 0.53 |

A single cell would be adequate to satisfy the needs of the small, occasional user.

The limiting current is in excess of 6 amps (0.75 amp/$cm^2$). The current limits are caused by diffusion polarization of the slurry to the electrode surface. By mixing the slurry higher currents can be achieved. The second parameter affecting the performance of the stack is the slurry temperature. At room temperature the oxalic acid solubility in water is approximately 10 wt %, increasing rapidly as temperature increases, thus decreasing diffusion polarization, an observation readily noticeable when the generator, operating at fixed current, is allowed to heat up, resulting in a decrease in cell voltage.

Experiments were conducted with the 5-cell stack of example 2, thermally insulated to allow operation at elevated temperatures, without the need for additional heat source. We have, generally observed that the stack voltage decreases by 43 millivolts for each degree Celsius of temperature rise.

At an operating temperature of 60 degrees Celsius, the following conditions were recorded:

| Stack current Amps | Stack voltage volts |
|---|---|
| 1.0 | 2.37 |
| 2.0 | 3.50 |
| 3.0 | 4.20 |
| 4.0 | 4.60 |
| 5.0 | 5.00 |
| 6.0 | 5.33 |

These results represent about 27% power consumption reduction over room temperature operation.

Example 2

A 5-cell stack, essentially in the form of FIG. 3, is placed in a container holding supersaturated oxalic acid, in form of a slurry. The cells having a surface area of 8.3 $cm^2$ each, are inter-connected in series and then connected to a DC power supply. The following results are obtained:

| Cell current | Stack voltage | Carbon dioxide generation | | Power consumption |
|---|---|---|---|---|
| Amps | volts | rate, Liters/hr | lbs/day | kilowatt/(lb$CO_2$/hr) |
| 1.16 | 4.10 | 5.2 | 0.5 | 0.24 |
| 1.82 | 4.73 | 8.2 | 0.8 | 0.26 |
| 2.18 | 4.95 | 9.8 | 1.0 | 0.27 |
| 2.65 | 5.20 | 12.0 | 1.2 | 0.28 |
| 3.00 | 5.35 | 13.7 | 1.3 | 0.29 |
| 4.00 | 5.80 | 18.2 | 1.8 | 0.31 |
| 5.00 | 6.37 | 22.8 | 2.3 | 0.34 |

A small 5-cell stack would be adequate to satisfy the needs of small users consuming less than 2.5 lbs of $CO_2$/day.

Note that by a current adjustment the production rate is changed over a substantial dynamic range. Therefore a simple potentiometer would be adequate as a means of control of the generator output. In addition, the change in current results in an instantaneous change in carbon dioxide production rate.

Example 3

Based on these experimental results and a reduction in cell resistance the following stack capabilities are possible:

| | |
|---|---|
| Single cell size, $cm^2$ | 100 |
| Number of cells: | 50 |
| Current/cell, amps | 50 |
| Single cell voltage, volts: | 1.12 |
| Stack voltage, volts | 56 |
| Stack power, Kilowatts: | 2.8 |
| $CO_2$ production rate, lbs/hr or (Ton/day): | 9.3 (0.1) |
| Energy consumption, kilowatt-hr/lb $CO_2$: | 0.3 |
| Oxalic acid consumption/day, Tons: | ca. 0.1 |

This analysis shows that the electrolytic process is compatible with "on-site" generator capabilities as needed by small to medium-size users.

Example 4

Based on the previously described stack performance, the following capabilities are possible:

| | |
|---|---|
| Single cell size, $cm^2$: | 1,000 |
| Number of cells: | 50 |
| Current/cell, amps: | 500 |
| Stack voltage, VDC: | 56 |
| Stack power requirement, Kilowatt: | 28 |
| $CO_2$ production rate, Ton/day | 1 |

-continued

| Acid consumption rate, ton/day | |
|---|---|
| Anhydrous oxalic acid: | 1 |
| Dihydrate oxalic acid: | 1.4 |

Example 5

Two 8.3 $cm^2$ cells of the type described in this application, placed back-to-back (anodes facing each other) with cathodes exposed to air, are used to extract $H_2$ from a gas stream generated from a 5-cell $CO_2$ generator stack, described previously.

The voltage at a current of 400 milliamps is 0.5 volts; the limiting current, limited by the air cathode, is about 3 amps. This stack is capable of removing 1.5 liters/hour of hydrogen gas from the gas stream.

Four pairs of cells would be adequate to remove the hydrogen generated from a 12 liters/hour (1.2 lbs/day) $CO_2$ generator.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and the number and configuration of various components described above may be altered, all without departing from the spirit or scope of the invention as defined in the appended Claims.

The invention claimed is:

1. A generator having a stack of electrochemical cells for producing carbon dioxide and hydrogen from an organic carboxylated acid solution comprising:

at least two individual electrochemical cells; there would be a left end first electrochemical cell and a right end second electrochemical cell;

said first and second electrochemical cells being spaced from each other to form a stack having a left end and a right end;

said first electrochemical cell comprising a first central ionic conductor member having a left outer surface and a right outer surface; a first left side electrode is pressed against said left outer surface and a first right side electrode is pressed against said right outer surface; said first electrochemical cell being located at said left end of said stack;

said second electrochemical cell comprising a second central ionic conductor member having a left outer surface and a right outer surface; a second left side electrode is pressed against said left outer surface and a second right side electrode is pressed against said right outer surface; said second electrochemical cell being located at said right end of said stack;

a first current collector means is connected to said first left side electrode and it would have a $1^{st}$ electrical terminal;

a second current collector means is connected to said first right side electrode and it would have a $2^{nd}$ electrical terminal;

a third current collector means is connected to said second left side electrode and it would have a $3^{rd}$ electrical terminal;

said second and third current collectors means being electrically connected to each other in series;

a fourth current collector means is connected to said second right side electrode and it would have a $4^{th}$ electrical terminal;

an electrical power source is electrically connected between said $1^{st}$ electrical terminal and said $4^{th}$ electrical terminal;

a primary container having a reservoir chamber; and an aqueous solution is located in said reservoir chamber; and said stack of electrochemical cells is located in said reservoir chamber.

2. A generator as recited in claim 1 wherein said aqueous solution is an organic acid.

3. A generator as recited in claim 1 wherein said aqueous solution is a solid organic acid.

4. A generator as recited in claim 1 wherein said electrochemical cells are aligned with each other.

5. A generator as recited in claim 1 wherein there is a tab portion extending from each of said current collector means.

6. A generator as recited in claim 1 wherein said current collector means have a grid-like structure whose open spaces allow the aqueous solution to have increased contact with the outer surfaces of said left and right side electrodes.

7. A generator as recited in claim 1 wherein there are more than two electrochemical cells and they each comprise: a central ionic conductor member having a left outer surface; a left side electrode pressed against said left outer surface and a right side electrode pressed against said right side outer surface; a left side current collector is connected to said left side electrode and a right side current collector is connected to said right side current collector.

8. A generator as recited in claim 7 wherein said additional electrochemical cells are positioned between said left end first electrochemical cell and said right end second electrochemical cell; said respective additional left side electrodes and said respective additional right side electrodes of said additional electrochemical cells being electrically connected in series between said first right side electrode and said second left side electrode of said respective left end first electrochemical cell and said respective right end second electrochemical cell.

9. A generator as recited in claim 1 further comprising a left end plate and a right end plate and said pair assemblies of said electrochemical cells are positioned therebetween; a plurality of rod members fasten said left and right end plates together.

10. A generator as recited in claim 9 wherein end plates have numerous open passages to allow said aqueous solution to flow freely therethrough for improved contact with said electrodes of said respective electrochemical cells.

11. A generator as recited in claim 1 further comprising spacer members between said respective electrochemical cells to maintain a predetermined separation between adjacent electrochemical cells.

12. A generator as recited in claim 1 further comprising insulation means for said container so that the temperature of said aqueous solutions will increase during operation of said generator to improve its performance.

13. A generator as recited in claim 1 wherein said aqueous solution is a slurry of anhydrous oxalic acid.

14. A generator as recited in claim 1 wherein said aqueous solution is a slurry of oxalic acid dihydrate.

15. A generator as recited in claim 1 wherein said ionic conductor member is an ion exchange member.

16. A generator as recited in claim 1 wherein said ionic conductor is a porous non-metallic material capable of holding aqueous solution.

17. A generator as recited in claim 1 wherein said electrical power source is a DC power source.

18. A generator as recited in claim 17 wherein said DC power source is a battery.

19. A generator as recited in claim 17 wherein said DC power source is an AC/DC converter.

20. A generator as recited in claim 17 wherein said DC power source is a solar photovoltaic cell module.

21. A generator as recited in claim 1 wherein said generator has means for producing an exhaust stream of $CO_2$ and $H_2$ and said exhaust mixed gas stream is connected to means for scrubbing oxalic acid that is present from said exhaust mixed gas stream.

22. A generator as recited in claim 21 further comprising water recycling means for returning water separated from said exhaust mixed gas stream back to said primary container.

23. A generator as recited in claim 21 further comprising means for processing the exhaust gas stream after it has been scrubbed of oxalic acid and next producing substantially pure separated $H_2$ and $CO_2$ gases.

24. A generator as recited in claim 1 further comprising supply means for continuously supplying more aqueous solution that has been consumed by said generator.

25. A generator having a stack of electrochemical cells for producing carbon dioxide and hydrogen from an organic carboxylated acid solution comprising:

at least two individual electrochemical cells; there would be a left end first electrochemical cell and a right end second electrochemical cell;

said first and second electrochemical cells being spaced from each other to form a stack having a left end and a right end;

said first electrochemical cell comprising a first central ionic conductor member having a left outer surface and a right outer surface; a first left side electrode is pressed against said left outer surface and a first right side electrode is pressed against said right outer surface; said first electrochemical cell being located at said left end of said stack;

said second electrochemical cell comprising a second central ionic conductor member having a left outer surface and a right outer surface; a second left side electrode is pressed against said left outer surface and a second right side electrode is pressed against said right outer surface; said second electrochemical cell being located at said right end of said stack;

said left outer surface and a second right side electrode is pressed against said right outer surface;

a primary container having a reservoir chamber;

an aqueous solution is located in said reservoir chamber; and said stack of electrochemical cells is located in said reservoir chamber;

means forming a secondary container between said first electrochemical cell and said second electrochemical cell; said secondary container having a chamber therein that is watertight to prevent entry of said aqueous solution therein; said secondary container functions to receive hydrogen gas in said chamber from said right outer surface of said first central ionic conductor member and to receive hydrogen gas in said chamber from said left outer surface of said second central ionic conductor member; said secondary container having a hydrogen gas exit port;

a first current collector means is connected to said first left side electrode and it would have a $1^{st}$ electrical terminal;

a second current collector means is connected to said first right side electrode and it would have a $2^{nd}$ electrical terminal;

a third current collector means is connected to said second left side electrode and it would have a $3^{rd}$ electrical terminal;

said first and third current collectors means being electrically connected to each other in series;

a fourth current collector means is connected to said second right side electrode and it would have a $4^{th}$ electrical terminal; said second and fourth current collector means being electrically connected to each other in series;

an electrical power source having a positive electrical terminal and a negative electrical terminal; one of said terminals is electrically connected to said $1^{st}$ and $3^{rd}$ electrical terminals and said other terminal is electrically connected to said $2^{nd}$ and $4^{th}$ electrical terminal.

26. A generator as recited in claim 25 wherein said aqueous solution is an organic acid.

27. A generator as recited in claim 25 wherein said aqueous solution is a solid organic acid.

28. A generator as recited in claim 25 wherein said electrochemical cells are aligned with each other.

29. A generator as recited in claim 25 wherein there is a tab portion extending from each of said current collector means.

30. A generator as recited in claim 25 wherein said current collector means have a grid-like structure whose open spaces allow the aqueous solution to have increased contact with the outer surfaces of said left and right side electrodes.

31. A generator as recited in claim 25 wherein said first and second electrochemical cells form a first pair assembly and there are a plurality of said pair assemblies and they each have two electrochemical cells and each comprise: a central ionic conductor member having a left outer surface; a left side electrode pressed against said left outer surface and a right side electrode pressed against said right side outer surface; a left side current collector is connected to said left side electrode and a right side current collector is connected to said right side current collector.

32. A generator as recited in claim 31 wherein said additional pair assemblies are laterally spaced from each other and said first pair assembly to form a stack.

33. A generator as recited in claim 31 further comprising a left end plate and a right end plate and said pair assemblies of said electrochemical cells are positioned therebetween; a plurality of rod members fasten said left and right end plates together.

34. A generator as recited in claim 33 wherein end plates have numerous open passages to allow said aqueous solution to flow freely therethrough for improved contact with said electrodes of said respective electrochemical cells.

35. A generator as recited in claim 25 further comprising spacer members between said respective pair assemblies to maintain a predetermined separation between adjacent pair assemblies.

36. A generator as recited in claim 26 further comprising insulation means for said container so that the temperature of said aqueous solution will increase during operation of said generator to improve its performance.

37. A generator as recited in claim 27 wherein said aqueous solution is a slurry of anhydrous oxalic acid.

38. A generator as recited in claim 25 wherein said aqueous solution a slurry of oxalic acid dihydrate.

39. A generator as recited in claim 25 wherein said ionic conductor member is an ion exchange membrane.

40. A generator as recited in claim 25 wherein said ionic conductor is a porous non-metallic material capable of holding aqueous solution.

41. A generator as recited in claim 25 wherein said electrical power source is a DC power source.

42. A generator as recited in claim 41 wherein said DC power source is a battery.

43. A generator as recited in claim 41 wherein said DC power source is an AC/DC converter.

44. A generator as recited in claim 31 wherein said DC power source is a solar photovoltaic cell module.

45. A generator as recited in claim 25 wherein said generator has means for producing separate gas streams of $CO_2$ and $H_2$ and said exhaust streams are connected to means for scrubbing oxalic acid that is present from said exhaust gas streams.

46. A generator as recited in claim 45 further comprising water recycling for returning water separated from said exhaust gas streams back to said primary container.

47. A generator as recited in claim 45 further comprising means for processing the exhaust gas streams after they have been scrubbed of oxalic acid and next producing substantially pure separated $H_2$ and $CO_2$ gases.

48. A generator as recited in claim 25 further comprising supply means for continuously supplying more aqueous solution to said primary container to replace aqueous solution that has been consumed by said generator.

49. A generator having a stack of electrochemical cells for producing carbon dioxide and hydrogen from an organic carboxylated acid solution comprising:

at least a pair of individual electrochemical cells; there would be a left end first electrochemical cell and a right end second electrochemical cell;

said first and second electrochemical cells being spaced from each other to form a stack having a left end and a right end;

said first electrochemical cell comprising a first central ionic conductor member having a left outer surface and a right outer surface; a first left side electrode is pressed against said left outer surface and a first right side electrode is pressed against said right outer surface; said first electrochemical cell being located at said left end of said stack;

said second electrochemical cell comprising a second central ionic conductor member having a left outer surface and a right outer surface; a second left side electrode is pressed against said left outer surface and a second right side electrode is pressed against said right outer surface; said second electrochemical cell being located at said right end of said stack;

a primary container having a reservoir chamber;

an aqueous solution is located in said reservoir chamber; and said stack of electrochemical cells is located in said reservoir chamber;

means forming a secondary container between said first electrochemical cell and said second electrochemical cell; said secondary container having a chamber therein that is watertight to prevent entry of said aqueous solution therein; said secondary container functions to receive hydrogen gas in said chamber from said right outer surface of said first central ionic conductor member and to receive hydrogen gas in said chamber from said left outer surface of said second central ionic conductor member; said secondary container having an air inlet port; said secondary container having an open top end through which the mixed gas of hydrogen and air are free to escape;

a first current collector means is connected to said first left side electrode and it would have a $1^{st}$ electrical terminal;

a second current collector means is connected to said first right side electrode and it would have a $2^{nd}$ electrical terminal;

a third current collector means is connected to said second left side electrode and it would have a $3^{rd}$ electrical terminal;

said first and third current collectors means being electrically connected to each other in series;

a fourth current collector means is connected to said second right side electrode and it would have a $4^{th}$ electrical terminal; said second and fourth current collector means being electrically connected to each other in series; and an electrical power source having a positive electrical terminal and a negative electrical terminal; one of said terminals is electrically connected to said $1^{st}$ and $3^{rd}$ electrical terminals and said other terminal is electrically connected to said $2^{nd}$ and $4^{th}$ electrical terminals.

50. A generator as recited in claim 49 wherein said aqueous solution is an organic acid.

51. A generator as recited in claim 49 wherein said aqueous solution contains a solid organic acid.

52. A generator as recited in claim 49 wherein said electrochemical cells are aligned with each other.

53. A generator as recited in claim 49 wherein there is a tab portion extending from each of said current collector means.

54. A generator as recited in claim 49 wherein said current collector means have a grid-like structure whose open spaces allow the aqueous solution to have increased contact with the outer surfaces of said left and right side electrodes.

55. A generator as recited in claim 49 wherein said first and second electrochemical cells form a first pair assembly and there are a plurality of said pair assemblies and they each have two electrochemical cells and each comprise: a central ionic conductor member having a left outer surface; a left side electrode pressed against said left outer surface and a right side electrode pressed against said right side outer surface; a left side current collector is connected to said left side electrode and a right side current collector is connected to said right side current collector.

56. A generator as recited in claim 55 wherein said additional pair assemblies are laterally spaced from each other and said first pair assembly to form a stack.

57. A generator as recited in claim 55 further comprising a left end plate and a right end plate and said pair assemblies of said electrochemical cells are positioned therebetween; a plurality of rod members fasten said left and right end plates together.

58. A generator as recited in claim 57 wherein end plates have numerous open passages to allow said aqueous solution to flow freely therethrough for improved contact with said electrodes of said respective electrochemical cells.

59. A generator as recited in claim 49 further comprising spacer members between said respective pair assemblies to maintain a predetermined separation between adjacent pair assemblies.

60. A generator as recited in claim 49 further comprising insulation means for said container so that the temperature of said aqueous solution will increase during operation of said generator to improve its performance.

61. A generator as recited in claim 49 wherein said aqueous solution is a slurry of anhydrous oxalic acid.

62. A generator as recited in claim 49 wherein said aqueous solution a slurry of oxalic acid dihydrate.

63. A generator as recited in claim 49 wherein said ionic conductor member is an ion exchange membrane.

64. A generator as recited in claim 49 wherein said ionic conductor is a porous non-metallic material capable of holding aqueous solution.

65. A generator as recited in claim 49 wherein said electrical power source is a DC power source.

66. A generator as recited in claim 65 wherein said DC power source is a battery.

67. A generator as recited in claim 65 wherein said DC power source is an AC/DC converter.

68. A generator as recited in claim 65 wherein said DC power source is a solar photovoltaic cell module.

69. A generator as recited in claim 49 wherein said generator has means for producing an exhaust stream of $CO_2$ and separately a $H_2$ depleted gas stream mixed with excess air, and said exhaust mixed gas streams are connected to means for scrubbing oxalic acid that is present from said exhaust gas streams.

70. A generator as recited in claim 69 further comprising water recycling means for returning water separated from said exhaust gas streams back to said primary container.

71. A generator as recited in claim 69 further comprising means for processing the exhaust gas streams after they have been scrubbed of oxalic acid and next producing substantially a pure $CO_2$ gas stream.

72. A generator as recited in claim 49 further comprising supply means for continuously supplying more aqueous solution that has been consumed by said generator.

73. A generator producing carbon dioxide and hydrogen from an organic carboxylated acid solution comprising:

a container having a bottom wall, upstanding surrounding side walls and a top wall enclosing said side walls;

an upright oriented electrochemical cell module having structure for decomposing an organic acid, said electrochemical cell module having a left side surface, a right side surface and an upright oriented peripheral side edge;

an upright oriented partition wall extends downwardly from said top wall of said container across the width of said container to form a distinct first chamber and a distinct second chamber; said peripheral side edge of said electrochemical cell module is incorporated in said partition wall; said partition wall does not fully extend to the bottom of said container to allow for liquid motion between said first chamber and said second chamber without allowing gases to escape into the adjacent chambers; said first chamber having a carbon dioxide exit port and said second chamber having a hydrogen gas exit port;

said electrochemical cell module having a cathode and an anode;

a d.c. electrical power supply; and a primary electrical circuit connecting said anode and cathode to said d.c. electrical power supply to provide energy for generating carbon dioxide in said first chamber and hydrogen in said second chamber from an organic acid solution that would immerse said electrochemical cell module in said container.

74. A generator producing carbon dioxide and hydrogen from an organic carboxylated acid solution comprising:

a container having a bottom wall, upstanding surrounding side walls and a top wall enclosing said side walls;

an upright oriented electrochemical cell module having structure for decomposing an organic acid, said electrochemical cell module having a left side surface, a right side surface and an upright oriented peripheral side edge;

an upright oriented partition wall extends downwardly from said top wall of said container across the width of said container to form a distinct first chamber and a distinct second chamber; said peripheral side edge of said electrochemical cell module is incorporated in said partition wall; said partition wall also fully extends to the bottom of said container to provide complete separation between said first chamber and said second chamber; said first chamber having a carbon dioxide exit port and said second chamber having a hydrogen gas exit port;

said electrochemical cell module having a cathode and an anode;

a d.c. electrical power supply; and a primary electrical circuit connecting said anode and cathode to said d.c. electrical power supply to provide energy for generating carbon dioxide in said first chamber and hydrogen in said second chamber from an organic acid solution that would only be present in said first chamber and said organic acid solution would only immerse said left side surface of said electrochemical cell module in said container because hydrogen gas evolution from said right side surface of said electrochemical cell module does not require the presence of any organic acid solution in said second chamber.

* * * * *